US005967201A

United States Patent [19]

Gasior

[11] Patent Number: 5,967,201

[45] Date of Patent: Oct. 19, 1999

[54] DRAINAGE SYSTEM

[76] Inventor: Carlton L. Gasior, 5067 Park W. Ave., San Diego, Calif. 92117

[21] Appl. No.: 09/028,839

[22] Filed: Feb. 24, 1998

Related U.S. Application Data

[63] Continuation-in-part of application No. 29/061,863, Nov. 1, 1996, Pat. No. Des. 391,274.

[51] Int. Cl.[6] ..... B67C 11/00

[52] U.S. Cl. ..... 141/98; 141/106; 141/332; 141/340; 141/344; 184/1.5

[58] Field of Search ..... 141/331–342, 141/344–345, 98, 106; 184/1.5, 106; 251/326

[56] References Cited

U.S. PATENT DOCUMENTS

| | | | |
|---|---|---|---|
| 932,931 | 8/1909 | Willmann | 141/106 |
| 1,667,075 | 4/1928 | Lippold | 141/106 |
| 1,935,324 | 11/1933 | Lillard | 141/337 |
| 2,025,639 | 12/1935 | Bradford | 141/106 |
| 2,071,944 | 2/1937 | Hoffman | 141/106 |
| 2,073,914 | 3/1937 | Wilfley | 141/337 |
| 2,858,050 | 10/1958 | Barnard | 141/331 |
| 3,750,722 | 8/1973 | Nowak | 141/332 |
| 3,986,538 | 10/1976 | Sather | 141/332 |
| 4,089,506 | 5/1978 | Blake | 251/326 |
| 4,637,079 | 1/1987 | Hodge | 251/326 |
| 4,637,531 | 1/1987 | Olsson | 251/326 |
| 4,665,958 | 5/1987 | Holloway et al. | 141/106 |
| 4,789,017 | 12/1988 | Panasewicz et al. | 141/342 |
| 4,856,568 | 8/1989 | Murphy et al. | 141/337 |
| 4,970,817 | 11/1990 | Manfield | 141/340 |
| 5,228,488 | 7/1993 | Fletcher | 141/331 |
| 5,269,354 | 12/1993 | Koberg | 141/106 |
| 5,339,872 | 8/1994 | Marino | 141/337 |

FOREIGN PATENT DOCUMENTS

| | | | |
|---|---|---|---|
| 521844 | 6/1940 | United Kingdom | 141/341 |

*Primary Examiner*—J. Casimer Jacyna

[57] ABSTRACT

A drainage system is provided including a hollow housing and a flexible hose having a first end connected to a bottom of the housing and a second end with a oil port couple for being releasably connected to an oil port of a vehicle. Situated on the housing is a valve for selectively allowing a fluid within the housing to flow through the hose. Next provided is a hanging assembly mounted on the housing for hanging the same.

2 Claims, 1 Drawing Sheet

DRAINAGE SYSTEM

The present application is a continuation in part of an application filed on Nov. 1, 1996 under Ser. No. 29/061,863 now U.S. Pat. No. D391,274.

BACKGROUND OF THE INVENTION

1. Field of the Invention

The present invention relates to a drainage system and more particularly pertains to draining fluids from a plurality of containers into an oil port of a vehicle.

2. Description of the Prior Art

The use of funnels is known in the prior art. More specifically, funnels heretofore devised and utilized for the purpose of draining single containers of fluid within various ports of a vehicle are known to consist basically of familiar, expected and obvious structural configurations, notwithstanding the myriad of designs encompassed by the crowded prior art which have been developed for the fulfillment of countless objectives and requirements.

In this respect, the drainage system according to the present invention substantially departs from the conventional concepts and designs of the prior art, and in so doing provides an apparatus primarily developed for the purpose of draining fluids from a plurality of containers into an oil port of a vehicle.

Therefore, it can be appreciated that there exists a continuing need for a new and improved drainage system which can be used for draining fluids from a plurality of containers into an oil port of a vehicle. In this regard, the present invention substantially fulfills this need.

SUMMARY OF THE INVENTION

In view of the foregoing disadvantages inherent in the known types of funnels now present in the prior art, the present invention provides an improved drainage system. As such, the general purpose of the present invention, which will be described subsequently in greater detail, is to provide a new and improved drainage system which has all the advantages of the prior art and none of the disadvantages.

To attain this, the present invention essentially comprises a housing having an upper extent with a hollow cylindrical configuration. Coupled to a central extent of an outer surface of the upper extent is a C-shaped handle. An inverted U-shaped sleeve is mounted on the central extent of the outer surface of the cylinder and diametrically disposed with respect to the C-shaped handle. The housing further includes a lower extent having an inverted frusto-conical configuration with a large open top integrally coupled to an open bottom of the upper extent. The lower extent depends downwardly from the upper extent in coaxial relationship therewith. The lower extent further has a planar annular flange coupled about a small open bottom thereof. Integrally mounted to the open bottom of the lower extent of the housing is a threaded couple. Next provided is a divider unit including a plurality of planar rectangular plates. Each of such plates is coupled to an inner surface of the upper extent of the housing. As such, each of the plates intersect each other along a central axis of the housing. This affords a plurality of pie-shaped sections within an interior space of the housing. A flexible hose is included having a first end with a threaded couple mounted thereon. This threaded couple is adapted for being releasably connected to the threaded couple of the housing. A second end of the flexible hose is equipped with a oil port couple for being releasably connected to an oil port of a vehicle. Also included is a lid having a top with a planar circular configuration and a peripheral lip integrally coupled to a periphery of the top and depending downwardly therefrom. The lid is thus adapted for being removably coupled to the open top of the upper extent of the housing. For selectively allowing a fluid within the housing to flow through the hose, a valve is situated on the lower extent of the housing just above the annular flange. Finally, a hanging assembly is provided including a string having a first end with an eyelet formed thereon for coupling with the C-shaped handle of the housing. The string is further equipped with a second end having a connector coupled thereto. Such connector includes an inboard portion with a disk-shaped configuration having a first diameter. An outboard portion of the connector is integrally coupled to the inboard portion in concentric relationship therewith. The outboard portion has a disk-shaped configuration with a second diameter less than the first diameter. By this structure, the connector serves for being removably coupled within the sleeve of the housing. The outboard portion also takes the form of a cap which is adapted to be removably coupled to the threaded couple of the housing for containing fluid therein. The hanging assembly further includes an inverted J-shaped hook having a bottom end with a loop for slidably receiving the string for hanging purposes.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved drainage system which has all the advantages of the prior art funnels and none of the disadvantages.

It is another object of the present invention to provide a new and improved drainage system which may be easily and efficiently manufactured and marketed.

It is a further object of the present invention to provide a new and improved drainage system which is of a durable and reliable construction.

An even further object of the present invention is to provide a new and improved drainage system which is susceptible of a low cost of manufacture with regard to both materials and labor, and which accordingly is then susceptible of low prices of sale to the consuming public, thereby making such drainage system economically available to the buying public.

Still yet another object of the present invention is to provide a new and improved drainage system which provides in the apparatuses and methods of the prior art some of the advantages thereof, while simultaneously overcoming some of the disadvantages normally associated therewith.

Still another object of the present invention is to drain fluids from a plurality of containers into an oil port of a vehicle.

Lastly, it is an object of the present invention to provide a new and improved drainage system including a hollow housing and a flexible hose having a first end connected to a bottom of the housing and a second end with a oil port couple for being releasably connected to an oil port of a vehicle. Situated on the housing is a valve for selectively allowing a fluid within the housing to flow through the hose. Next provided is a hanging assembly mounted on the housing for hanging the same. Lastly, an annular flange is formed at the lower end of the housing for stability purposes when in use to abate tipping.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
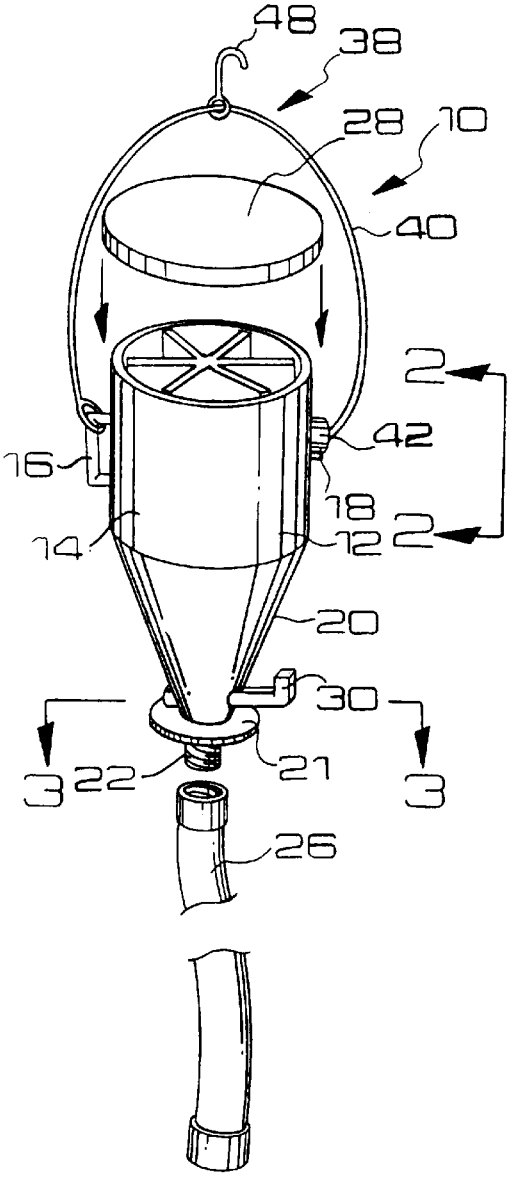
FIG. 1 is a perspective illustration of the preferred embodiment of the drainage system constructed in accordance with the principles of the present invention.
Figure 2:
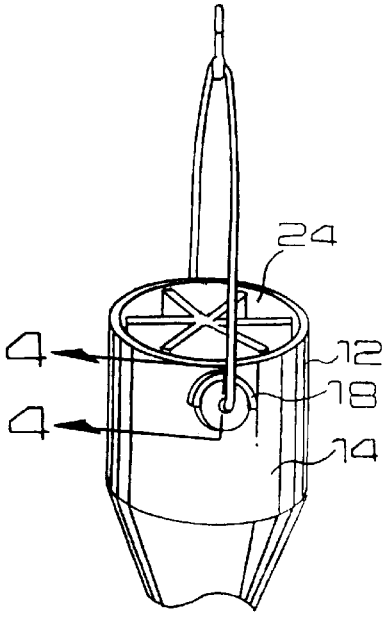
FIG. 2 is a side view of the present invention.
Figure 3:
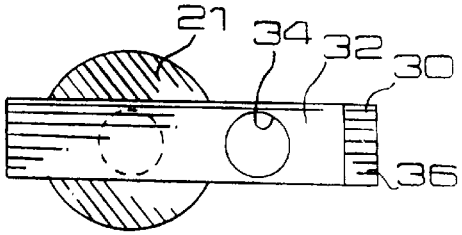
FIG. 3 is a cross-sectional view of the valve of the present invention taken along line 3—3 shown in FIG. 1.

With reference now to the drawings, and in particular to FIG. 1 thereof, a new and improved drainage system embodying the principles and concepts of the present invention and generally designated by the reference numeral 10 will be described.

The present invention, the new and improved drainage system, is comprised of a plurality of components. Such components in their broadest context include a housing, lid, hanging assembly and hose. Such components are individually configured and correlated with respect to each other so as to attain the desired objective.

More specifically, it will be noted that the system 10 of the present invention includes a housing 12 having an upper extent 14 with a hollow cylindrical configuration. Coupled to a central extent of an outer surface of the upper extent is a vertically oriented C-shaped handle 16. An inverted U-shaped sleeve 18 is mounted on the central extent of the outer surface of the cylinder and diametrically disposed with respect to the C-shaped handle. For reasons that will become apparent hereinafter, the U-shaped sleeve has a vertical cross-section with an L-shaped configuration. Note FIG. 4.

The housing further includes a lower extent 20 having an inverted frusto-conical configuration with a large open top integrally coupled to an open bottom of the upper extent. The lower extent depends downwardly from the upper extent in coaxial relationship therewith. The lower extent further has a planar annular flange 21 coupled about a small open bottom thereof. For reasons that will soon become apparent, the annular flange functions to allow the housing to be disposed within an opening of an engine of a vehicle without the housing tipping or falling over. Integrally mounted to the open bottom of the lower extent of the housing is a threaded couple 22. As shown in the Figures, the lower extent preferably has a height approximately equal to that of the upper extent.

Next provided is a divider unit 24 including a plurality of planar rectangular plates, preferably six, equally sized and spaced. Each of such plates is coupled to an inner surface of the upper extent of the housing. As such, each of the plates intersect each other along a central axis of the housing. This affords a plurality of separate pie-shaped sections within an interior space of the housing for supporting a plurality of inverted bottle neck containers therein for drainage purposes. The plates each have a similar size and shape and further extend along an entire height of the upper extent. As an option, the divider unit may be removable in nature with respect to the housing.

A flexible hose 26 is included having a first end with a threaded couple mounted thereon. This threaded couple is adapted for being releasably connected to the threaded couple of the housing. As an option, other types of male and female coupling means may be employed instead of the threaded coupling. A second or lower end of the flexible hose is equipped with a oil port couple for being releasably connected to an oil port of a vehicle. The design of the oil port couple may be varied to accommodate different vehicles. Such oil port couple at the lower end may well be a threaded coupling for attachment to the vehicle oil ports. Such threaded coupling could then be coupled to the threads at the upper end when not in use.

Also included is a lid 28 having a top with a planar circular configuration and a peripheral lip integrally coupled to a periphery of the top and depending downwardly therefrom. The lid is thus adapted for being removably coupled to the open top of the upper extent of the housing. Note FIG. 1.

For selectively allowing a fluid within the housing to flow through the hose, a valve 30 is situated on the lower extent of the housing just above the annular flange. The valve preferably includes a block 32 rotatably or threadedly or slidably situated within hermetically sealed cut outs formed in the sides of the lower extent. The block is equipped with a circular bore 34 and an upwardly extending grip 36. By this structure, the valve may be slid between a first orientation wherein the bore resides within the housing for allowing the flow of liquid. In a second orientation, the bore of the valve is positioned exterior of the housing and the block precludes the flow of liquid through the hose. It should be noted that various other types of valves or the like may be employed in lieu of the valve described hereinabove.

Figure 4:
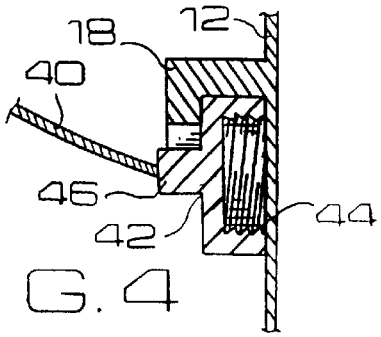
FIG. 4 is a side cross-sectional view of the inverted U-shaped sleeve of the present invention taken along line 4—4 shown in FIG. 2.

Finally, a hanging assembly 38 is provided including a string 40 having a first end with an eyelet formed thereon for coupling with the C-shaped handle of the housing. The string is further equipped with a second end having a connector 42 coupled thereto. Such connector includes an inboard portion 44 with a disk-shaped configuration having a first diameter. An outboard portion 46 of the connector is integrally coupled to the inboard portion in concentric relationship therewith. The outboard portion has a disk-shaped configuration with a second diameter less than the first diameter. As shown in FIG. 4, the outboard portion takes the form of a cap which is adapted to be removably coupled to the threaded couple of the housing for containing fluid therein. By this structure, the connector not only serves as a cap, but also to be removably situated within the inverted U-shaped sleeve of the housing. The hanging assembly further includes an inverted J-shaped hook 48 having a bottom end with a loop for slidably receiving the string for hanging purposes.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved drainage system comprising, in combination:

a housing including an upper extent with a hollow cylindrical configuration, the upper extent having a C-shaped handle coupled to a central extent of an outer surface thereof and an inverted U-shaped sleeve mounted on the central extent of the outer surface of the cylinder and diametrically disposed with respect to the C-shaped handle, the housing further including a lower extent having an inverted frusto-conical configuration with a large open top integrally coupled to an open bottom of the upper extent and depending downwardly therefrom in coaxial relationship therewith, the lower extent further having a planar annular flange coupled about a small open bottom thereof and a threaded couple integrally mounted to the open bottom of the lower extent of the housing below the annular flange;

a divider unit including a plurality of planar rectangular plates each coupled to an inner surface of the upper extent of the housing such that each of the plates intersect each other along a central axis of the housing, thereby affording a plurality of pie-shaped sections within an interior space of the housing;

a flexible hose having a first end with a threaded couple mounted thereon for being releasably connected to the threaded couple of the housing and a second end with a oil port couple for being releasably connected to an oil port of a vehicle;

a lid having a top with a planar circular configuration and a peripheral lip integrally coupled to a periphery of the top and depending downwardly therefrom for being removably coupled to the open top of the upper extent of the housing;

a valve situated on the lower extent of the housing just above the annular flange for selectively allowing a fluid within the housing to flow through the hose; and a hanging assembly including a string having a first end with an eyelet formed thereon for coupling with the C-shaped handle of the housing and a second end with a connector coupled thereto including an inboard portion with a disk-shaped configuration having a first diameter and an outboard portion integrally coupled to the inboard portion in concentric relationship therewith, wherein the outboard portion has a disk-shaped configuration with a second diameter less than the first diameter for being removably coupled within the sleeve of the housing, wherein the outboard portion also takes the form of a cap which is adapted to be removably coupled to the threaded couple of the housing for containing fluid therein, the hanging assembly further including an inverted J-shaped hook having a bottom end with a loop for slidably receiving the string for hanging purposes.

2. A drainage system comprising:

a hollow housing;

a flexible hose having a first end connected to a bottom of the housing and a second end with an oil port couple for being releasably connected to an oil port of a vehicle;

a valve situated on a lower extent of the housing, the valve including a block slidably situated within hermetically sealed cut outs formed in sides of the lower extent, the block being equipped with a circular bore, the valve being slidable between a first orientation wherein the bore resides within the housing for allowing a flow of liquid, in a second orientation, the bore of the valve being positioned exterior of the housing and the block for precluding the flow of liquid through the hose;

a support means for supporting a plurality of containers above the housing for draining the same simultaneously;

a plurality of openings formed in the support means; and a divider defining the openings, the divider defining a plurality of pie-shaded sections with an interior space of the housing.

* * * * *